US010544598B2

(12) United States Patent
Ahonen

(10) Patent No.: US 10,544,598 B2
(45) Date of Patent: Jan. 28, 2020

(54) APPARATUS FOR GRINDING A CONCRETE FLOOR SURFACE

(71) Applicant: Mika Ahonen, Kyröskoski (FI)

(72) Inventor: Mika Ahonen, Kyröskoski (FI)

( * ) Notice: Subject to any disclaimer, the term of this patent is extended or adjusted under 35 U.S.C. 154(b) by 223 days.

(21) Appl. No.: 15/744,552

(22) PCT Filed: Apr. 8, 2016

(86) PCT No.: PCT/FI2016/050221
§ 371 (c)(1),
(2) Date: Jan. 12, 2018

(87) PCT Pub. No.: WO2017/009524
PCT Pub. Date: Jan. 19, 2017

(65) Prior Publication Data

US 2018/0202176 A1 Jul. 19, 2018

(30) Foreign Application Priority Data

Jul. 16, 2015 (FI) ..... 20155559

(51) Int. Cl.
*B24B 7/06* (2006.01)
*E04F 21/24* (2006.01)
(Continued)

(52) U.S. Cl.
CPC ..... *E04F 21/245* (2013.01); *B24B 7/186* (2013.01); *B24D 7/066* (2013.01)

(58) Field of Classification Search
CPC ..... B24B 7/186; B24D 7/066; E04F 21/245
(Continued)

(56) References Cited

U.S. PATENT DOCUMENTS 1,609,508 A * 12/1926 Cavicchi ..... B24B 7/18 451/353
1,928,390 A * 9/1933 Myers ..... B24B 41/047 451/353

(Continued)

FOREIGN PATENT DOCUMENTS

DE 202011101564 U1 11/2011
KR 20140100712 A 8/2014

(Continued)

OTHER PUBLICATIONS

Supplementary European Search Report of European Application No. EP 16 82 3938.2 dated Jun. 12, 2019 (3 pages).

(Continued)

*Primary Examiner* — George B Nguyen
(74) *Attorney, Agent, or Firm* — Venable LLP; Jeffri A. Kaminski

(57) ABSTRACT

An apparatus for grinding a concrete floor surface, in order to perform grinding with a manual, a pullable or a ride-on concrete trowel machine is provided. The apparatus comprises a concrete trowel organ to be used with the concrete trowel machine and a diamond grinding arrangement, such as one or several diamond disks or like, to be coupled in connection with the concrete trowel organ removably by means of a fastening arrangement. The fastening arrangement for coupling the diamond grinding arrangement in connection with the concrete trowel organ comprises a fastening frame, being in connection with the diamond grinding arrangement that exits on a scrubbing surface of the concrete trowel organ, and a fastening part extending from the fastening frame and, while going through the concrete trowel organ, getting supported against a back surface of the same.

6 Claims, 10 Drawing Sheets

(51) Int. Cl.
*B24D 7/06* (2006.01)
*B24B 7/18* (2006.01)

(58) Field of Classification Search
USPC ..... 451/353, 548
See application file for complete search history.

(56) References Cited

U.S. PATENT DOCUMENTS

| | | | | |
|---|---|---|---|---|
| 5,548,860 | A * | 8/1996 | Weltikol | A47L 11/16 15/49.1 |
| 5,586,930 | A | 12/1996 | Hayashi et al. | |
| 6,058,922 | A | 5/2000 | Sexton | |
| 6,261,164 | B1 * | 7/2001 | Rivard | A47L 11/164 451/353 |
| 7,255,513 | B2 | 8/2007 | Lampley et al. | |
| 7,481,602 | B2 | 1/2009 | Lampley et al. | |
| 8,272,924 | B2 * | 9/2012 | Van Eijden | B24D 7/066 451/353 |
| 2006/0025059 | A1 | 2/2006 | Gueorguiev et al. | |
| 2006/0188334 | A1 | 8/2006 | Lampley et al. | |
| 2007/0264917 | A1 | 11/2007 | Lundberg et al. | |
| 2008/0176497 | A1 | 7/2008 | Estes | |
| 2009/0190999 | A1 | 7/2009 | Copoulos | |
| 2012/0270483 | A1 | 10/2012 | Bae et al. | |
| 2013/0129419 | A1 | 5/2013 | Hanson et al. | |
| 2016/0136772 | A1 | 5/2016 | Littlefield et al. | |
| 2017/0043445 | A1 * | 2/2017 | Lilienberg | B24B 27/0007 |
| 2017/0362836 | A1 * | 12/2017 | Tchakarov | B24D 7/066 |

FOREIGN PATENT DOCUMENTS

| | | | |
|---|---|---|---|
| WO | 2007011289 | A1 | 1/2007 |
| WO | 2010027312 | A1 | 3/2010 |
| WO | 2011090483 | A1 | 7/2011 |

OTHER PUBLICATIONS

First Office Action of corresponding Finnish Application No. 20155559, dated Mar. 16, 2016 (8 pages including search report).
International Search Report of PCT/F12016/050221 dated Jul. 12, 2016 (6 pages).
International Preliminary Report on Patentability of PCT/FI2016/050221 dated May 11, 2017 (7 pages).
Written Opinion of PCT/F12016/050221 dated Jul. 12, 2016 (8 pages).

* cited by examiner

APPARATUS FOR GRINDING A CONCRETE FLOOR SURFACE

CROSS-REFERENCES TO RELATED APPLICATIONS

This application is a U.S. National Stage application of PCT/FI2016/050221, filed Apr. 8, 2016 and published on Jan. 19, 2017 as WO/2017/009524, which claims the benefit of Finnish Patent Application No. 20155559, filed Jul. 16, 2015, all of which are hereby incorporated by reference in their entireties.

The invention relates to an apparatus for grinding a concrete floor surface according to the preamble of the independent claim directed thereto, in order to perform grinding with a manual, a pullable and/or a drive-on concrete trowel machine.

Figure 1:
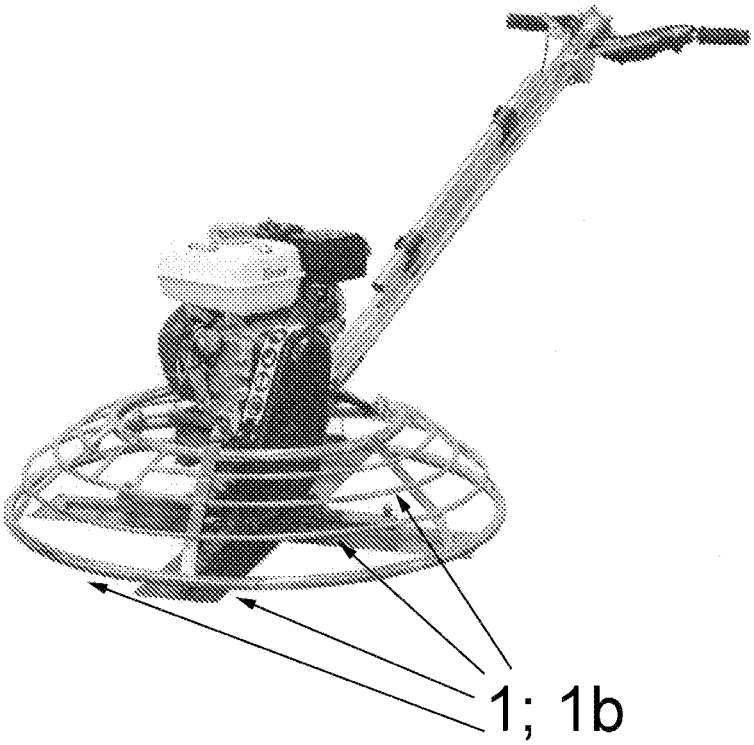
Figure 2:
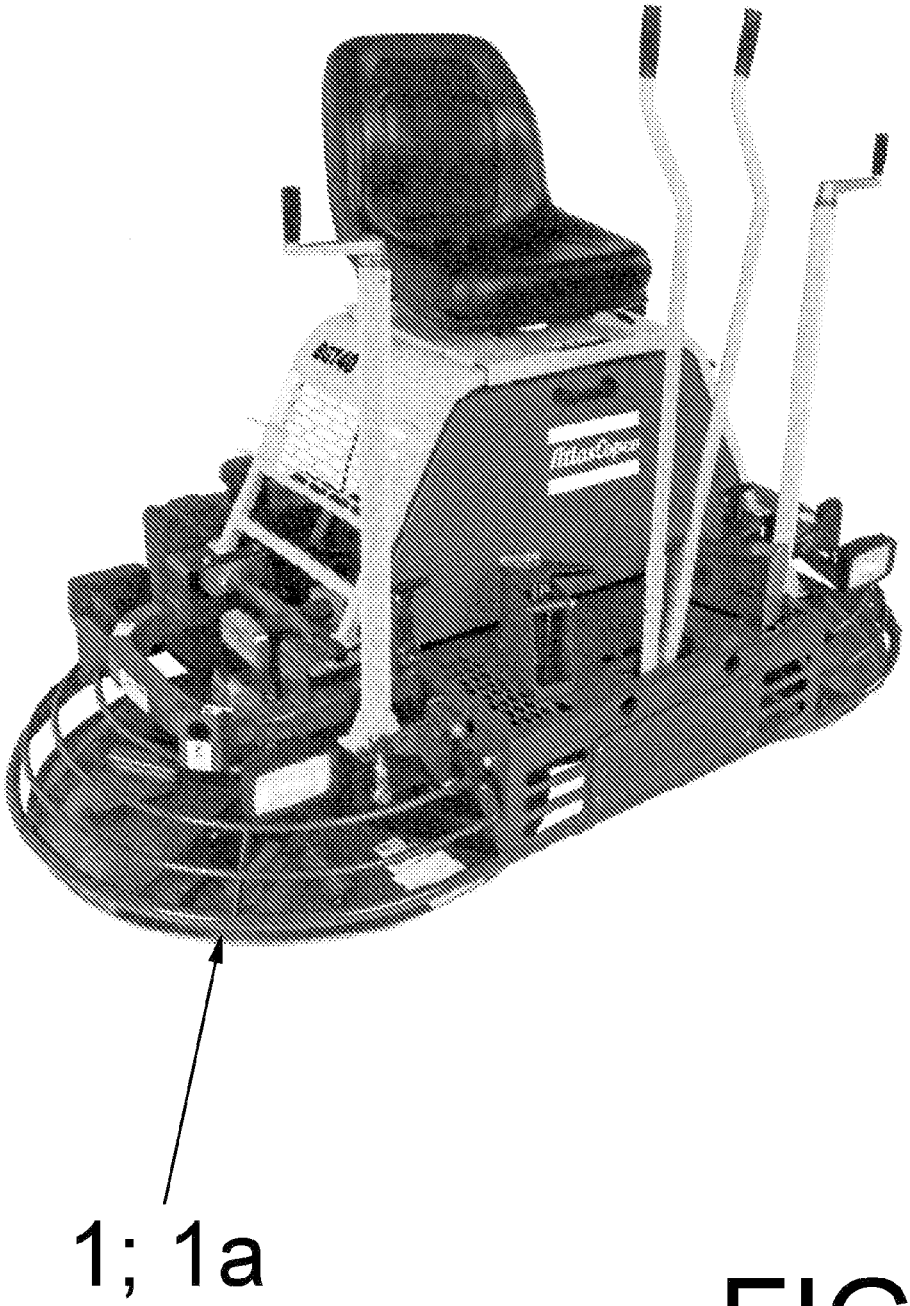

It is known to use in the above mentioned purpose e.g. as shown in FIG. 1, a manual or, as shown in FIG. 2, a drive-on type of concrete trowel machine. A driving end or a so called rotor in this type of a concrete trowel machine typically consists of four coupling arms perpendicular to each other, having e.g. elongated trowel wings, as shown in FIG. 1, or a uniform trowel plate, as shown in FIG. 2, fastened thereto.

Especially in connection with a trowel plate it is known to use porous washing, polishing or waxing disks e.g. being affixed to its scrubbing surface with a sticker coupling and having diamond disks fastened in a circle thereon especially for grinding a concrete floor surface. In this case thorough cleaning of the trowel plate is required before the sticker tapes are being attached thereto, as well as cleanness of the sticker surfaces, in order to keep the disk provided with diamond disks reliably attached to the scrub plate.

On the other hand, e.g. U.S. Pat. Nos. 7,255,513 and 7,481,602 disclose solutions for the diamond grinding of a concrete surface that differ from the above described, whereby in the former patent there is presented a diamond coating to be attached onto a scrubbing surface of a trowel wing with a suitable middle layer. In the latter patent, for its part, there is presented a corresponding solution as described above being used in connection with a circular trowel plate, as well as a coupling arrangement for coupling the diamond disks rotatably onto the scrubbing surface of the trowel plate with three backing discs and rotation mechanisms.

Arranging a diamond grinding surface straight onto the scrubbing surface of trowel wings or a trowel plate is disadvantageous first of all in that respect that scrubbing tools executed with such trowel organs are single-use and only applicable for diamond grinding. On the other hand, diamond disks to be used on the principle according to U.S. Pat. No. 7,481,602, are being attached onto the scrubbing surface of the trowel plate with multiple middle layers, due to which the actual diamond grinding surface remains quite far apart from the trowel plate. Thus, coupling thereof causes both mechanical strain and vibration, which is why the efficient service life of the diamond grinding equipment in question remains short even despite the fact that they are able to rotate on the scrubbing surface.

Because the rotation speed of the concrete trowel machines may be considerably high, there is also a risk in the diamond grinding with present solutions that the fastening of the diamond grinding equipment gives way in away that bigger or smaller particles may get thrown out from the scrubbing surface with a high speed causing thus a work safety hazard in addition to other possible damages.

It is an aim of the apparatus for grinding a concrete floor surface according to the present invention to bring about a decisive improvement particularly in the problems described above and thus to raise essentially the level of prior art. In order to carry out this aim, the apparatus for grinding a concrete floor surface according to the invention is mainly characterized by what has been presented in the characterizing part of the independent claim directed thereto.

As the most important advantages of the apparatus according to the invention may be mentioned simplicity and efficiency of the parts and subsystems related thereto as well as use thereof first of all thanks to the fact that the diamond grinding equipment may be attached in a fast and reliable manner to the concrete trowel organ, such as a trowel plate or trowel wings, without the risk e.g. of the diamond disk or parts thereof getting loosened involuntarily during grinding. As an advantageous embodiment of the invention, a coupling arrangement of the diamond grinding arrangement therefore comprises a perforation through e.g. the trowel plate or the trowel wing, wherein a fastening part going through the perforation and being coupled with a fastening frame of the diamond grinding arrangement is arranged to be affixed to the trowel organ. In this way it is made possible first of all that the actual diamond grinding surface is as close as possible to the scrubbing surface of the trowel plate or the trowel wing and on the other hand that a reliable coupling of the grinding equipment in question in a removable manner in connection with each trowel organ is achieved, wherein the trowel organs may be constantly used, when necessary by changing the diamond disks when necessary, and wherein the trowel organs are furthermore suitable also for scrubbing to be performed without the diamond disks.

Furthermore, when implementing the invention advantageously, the fastening frame is coupled in connection with the diamond disk utilized on the scrubbing surface of the trowel organ chemically, such as by gluing, mechanically, such as by a sticker gripping or a snap joint coupling, melting, such as by welding or injection moulding and/or in a corresponding manner, thanks to which it is possible to ensure a uniform, compact and an as "low" as possible diamond grinding equipment entirety, from which parts cannot get loose involuntarily. Attachment of the diamond grinding arrangement, such as the diamond disk, can be made even more efficient e.g. by utilizing as the fastening frame's fastening part arrangements that get locked against the trowel organ's back surface. Furthermore, as an advantageous embodiment, spring means are being utilized in the invention in order to make possible deflection motions of the diamond disks with respect to the concrete trowel organ.

Other advantageous embodiments of the apparatus according to the invention have been presented in the dependent claims directed thereto.

Figure 3A:
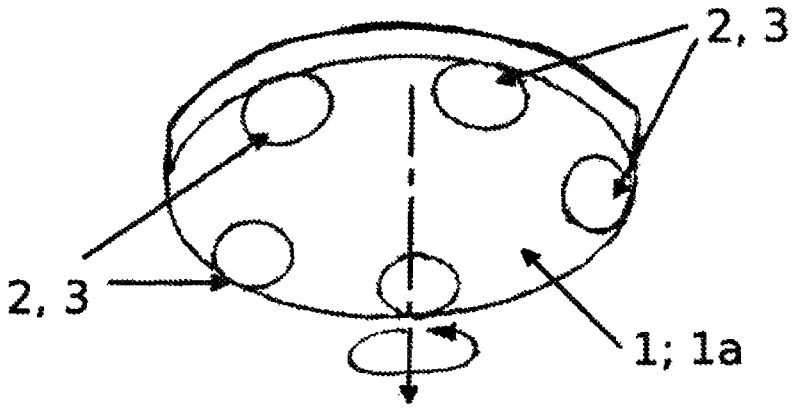
Figure 3B:
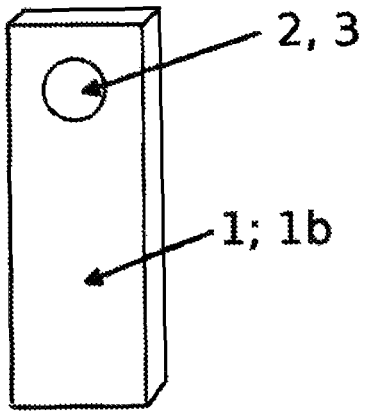
Figure 4A:
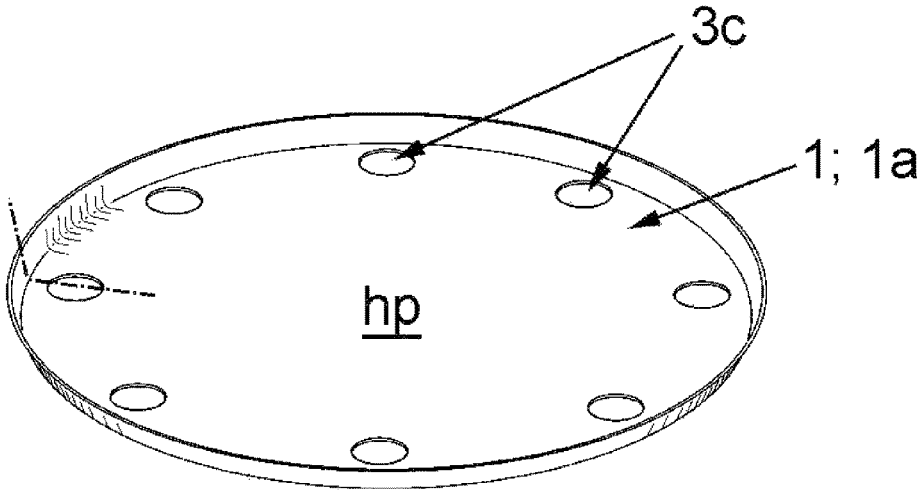
Figure 4B:
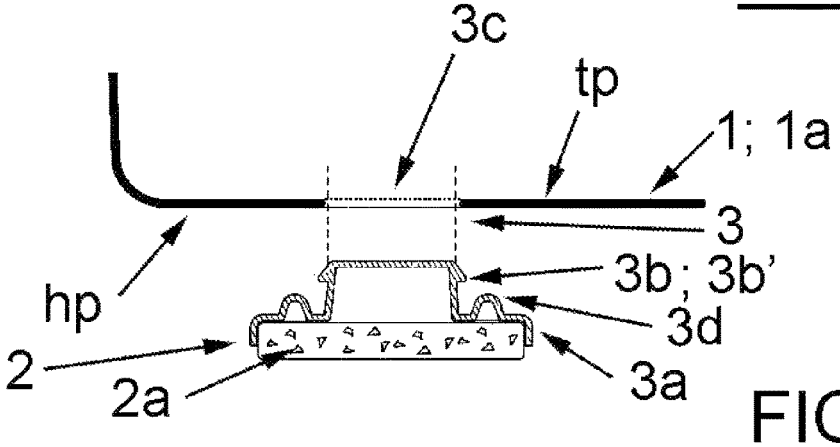
Figure 4C:
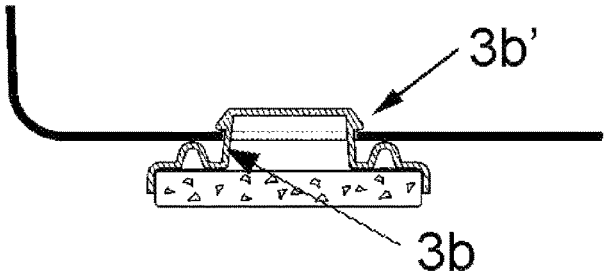
Figure 4D:
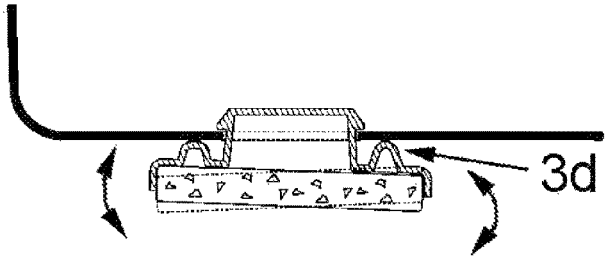
Figure 5A:
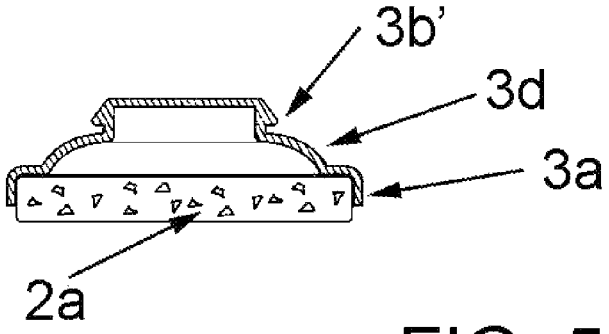
Figure 5B:
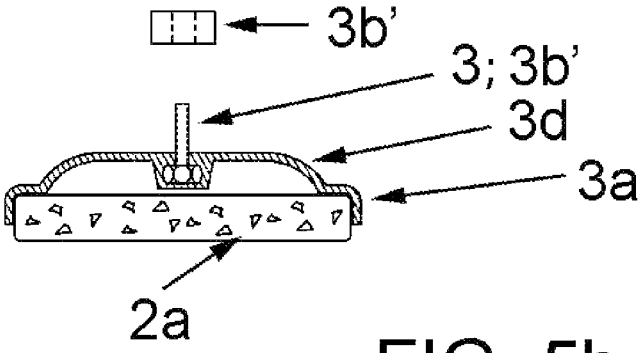
Figure 6A:
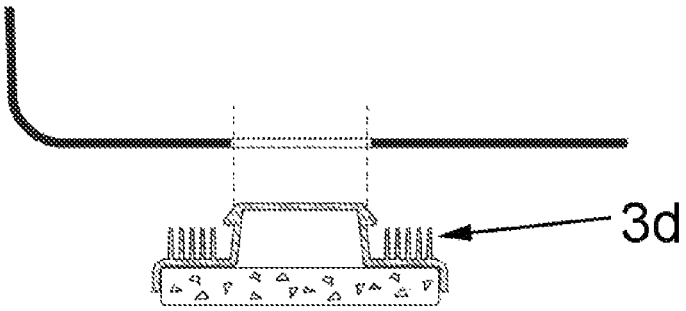
Figure 6B:
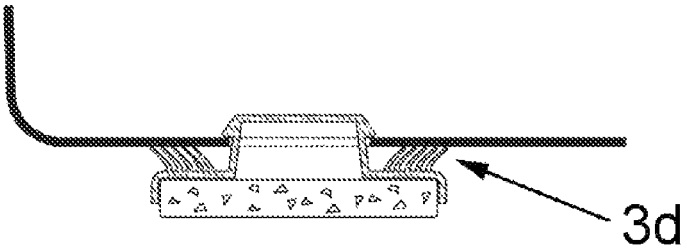
Figure 6C:
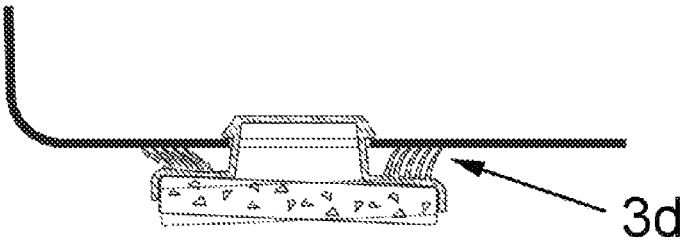
Figure 7A:
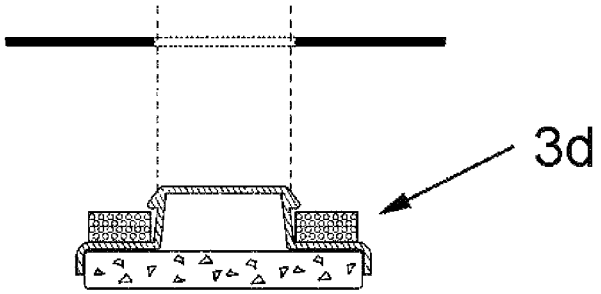
Figure 7B:
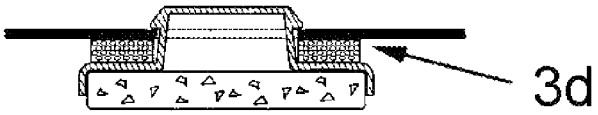
Figure 7C:
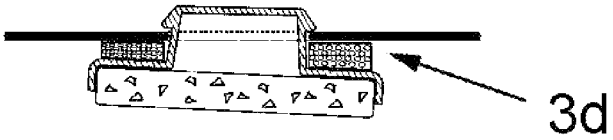
Figure 8:
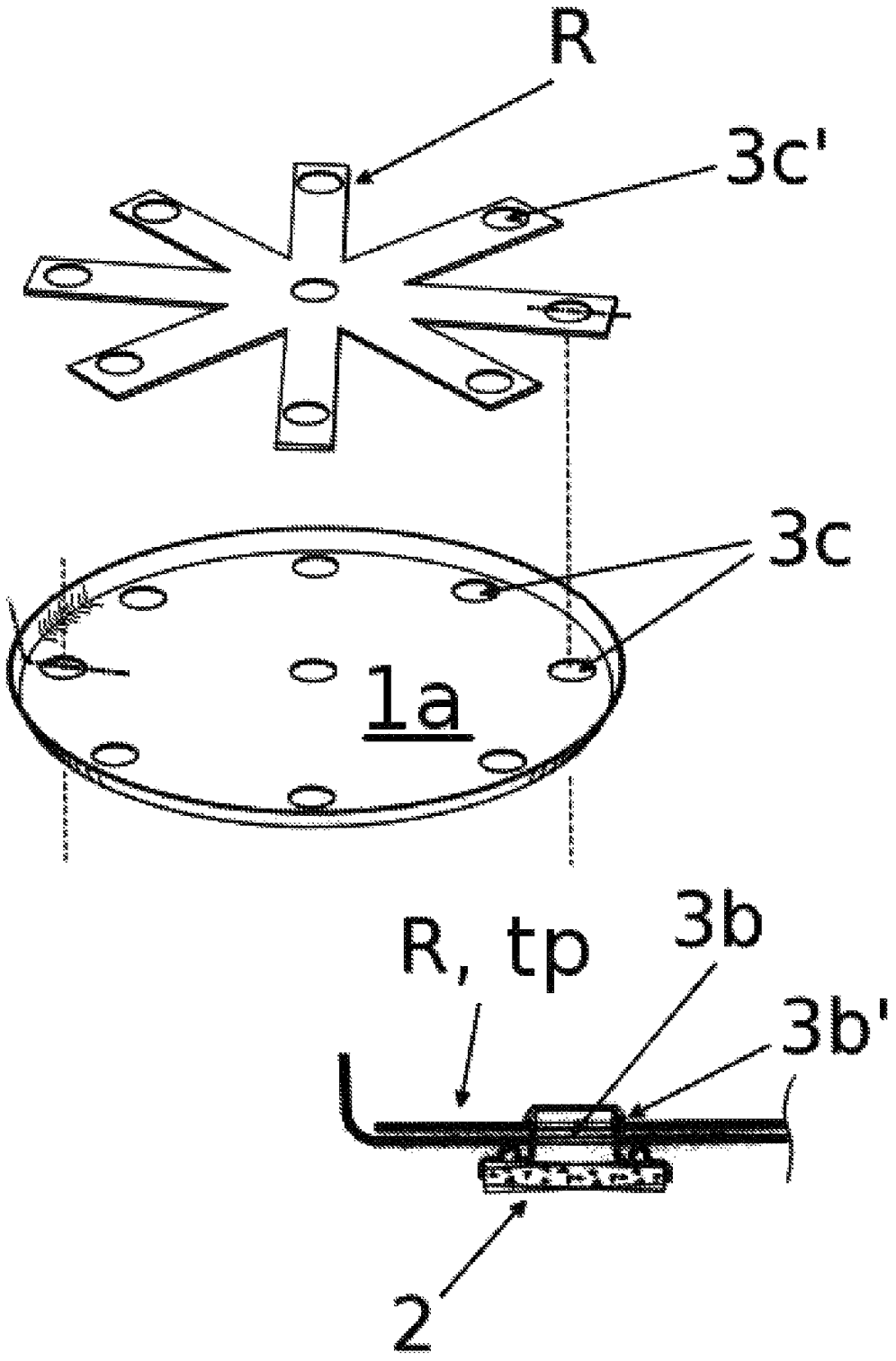
Figure 9:
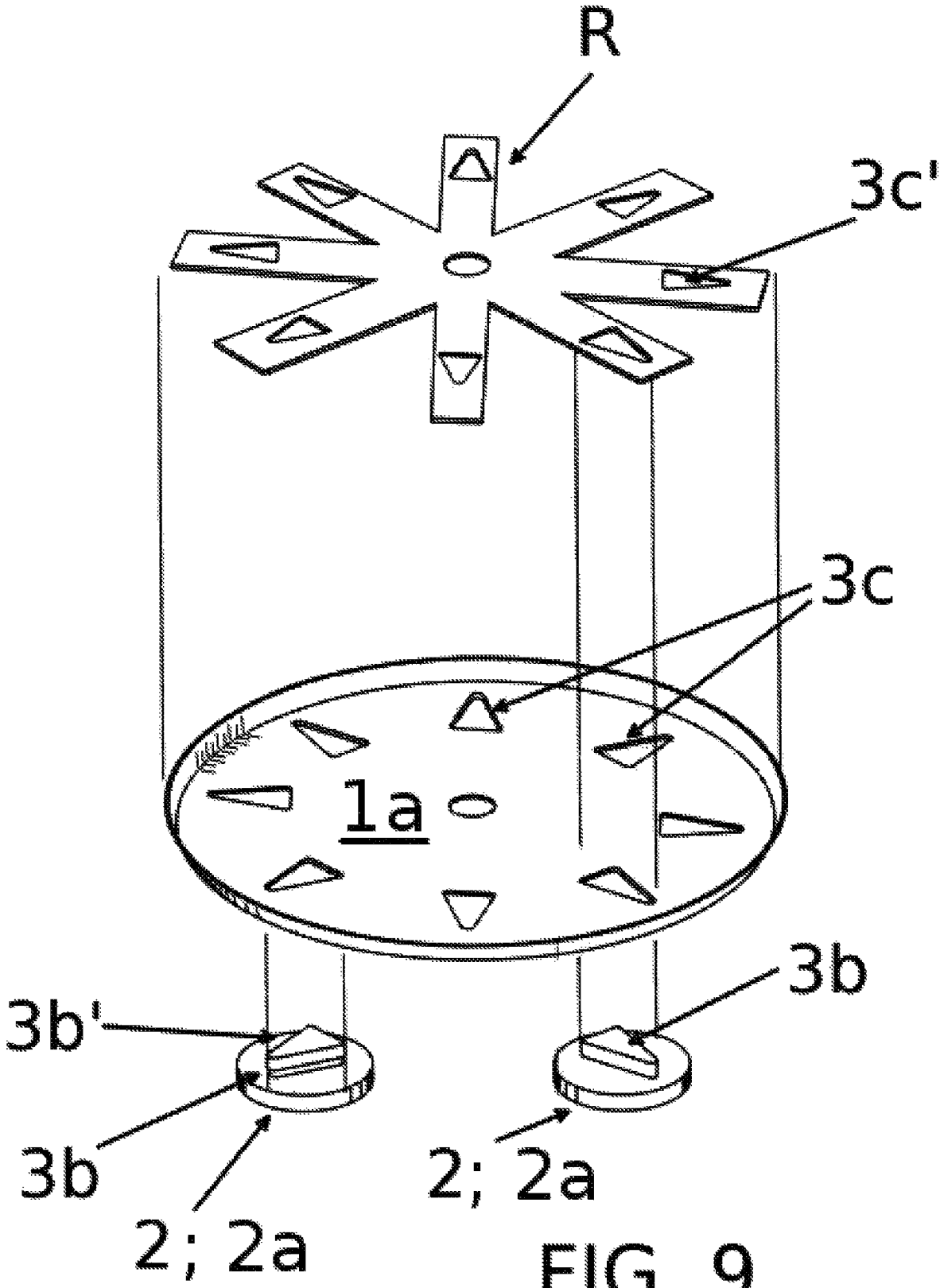
Figure 10A:
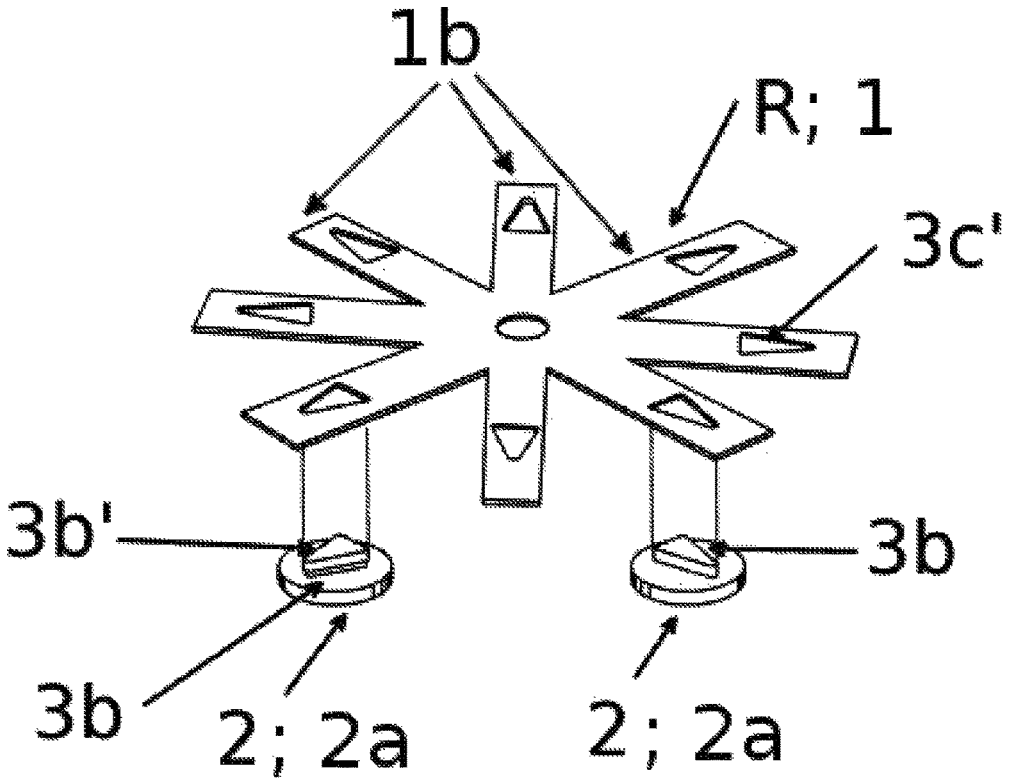
Figure 10B:
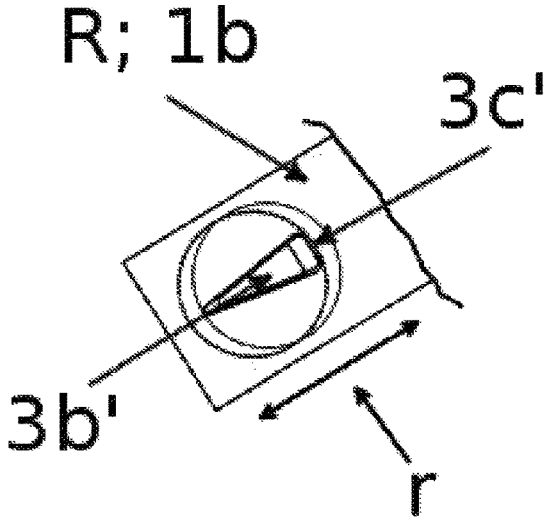
Figure 10C:
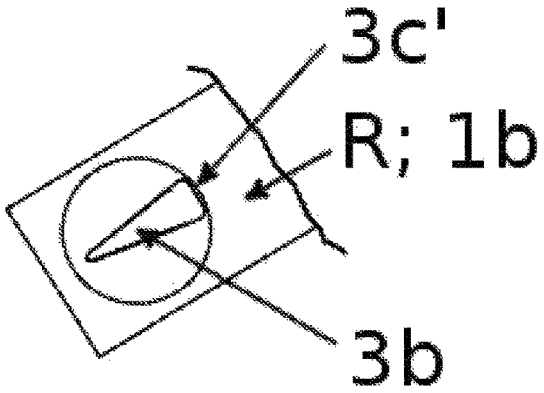

In the following description the invention is being illustrated in detail with reference to the appended drawings, in which in FIG. 1 is shown a typical manual concrete trowel machine, having trowel wings attached to the rotor thereof, in FIG. 2 is shown furthermore a typical drive-on concrete trowel machine, having a trowel plate attached to the rotor thereof, in FIGS. 3*a* and 3*b* are shown as perspective views a trowel plate and a trowel wing equipped with a concrete grinding equipment according to the invention, in FIGS. 4*a*-4*d* are shown first of all a perspective view of a trowel plate to be used in the apparatus according to the invention and with consecutive phases the coupling of a diamond disk equipped with a fastening frame onto the scrubbing surface of a trowel plate in a manner enabling a deflection motion of the diamond disk, in FIGS. 5*a* and 5*b* are shown furthermore some alternative spring and fastening arrangements of the diamond disk's fastening frame, in FIGS. 6*a*-6*c* are shown furthermore an advantageous alternative spring arrangement of the diamond disk's fastening frame and the fastening thereof to the trowel plate in a manner enabling a deflection motion of the diamond disk, in FIGS. 7*a*-7*c* are shown views corresponding to FIGS. 6*a*-6*c* of a further alternative fastening of the diamond disk in connection with a trowel plate or a trowel wing, in FIG. 8 are shown as exemplary perspective views a rotor with multiple arms and the trowel plate to be used in connection therewith, and as a cross section an advantageous fastening principle of a diamond grinding arrangement belonging to the apparatus according to the invention, in FIG. 9 is shown an alternative embodiment with respect to FIG. 8 of two alternative fastening arrangements of a diamond disk having a fastening part with a wedge-like cross section, and in FIGS. 10*a*-10*c* are shown first of all as a perspective view a rotor to be used as a concrete trowel organ, and on the other hand as views from above diamond disks coupled to the fastening arms thereof with two alternative coupling arrangements.

The invention relates to an apparatus for grinding a concrete floor surface, in order to perform grinding e.g. as shown in FIG. 1 with a manual, a pullable or e.g. as shown in FIG. 2 a ride-on concrete trowel machine. The apparatus comprises a concrete trowel organ 1 to be used with the concrete trowel machine and a diamond grinding arrangement 2, such as one or several diamond disks 2*a* or like, to be coupled in connection with the concrete trowel organ removably by means of a fastening arrangement. The fastening arrangement 3 for coupling the diamond grinding arrangement 2 in connection with the concrete trowel organ 1 comprises e.g. with reference to FIG. 4*b* a fastening frame 3*a*, being in connection with the diamond grinding arrangement 2 that exists on a scrubbing surface hp of the concrete trowel organ, and a fastening part 3*b* extending from the fastening frame and getting supported on the concrete trowel organ 1 while going through the same.

As an advantageous embodiment of the apparatus according to the invention, the concrete trowel organ 1 comprises a metallic trowel plate 1*a* or trowel wings 1*b*, wherein back surfaces thereof are provided with a coupling arrangement (that has not been shown in more detail in the drawings) for the coupling of the concrete trowel organ with a concrete trowel machine's rotor R e.g. having customarily four or as shown in FIGS. 8-10 more than four arms. In FIG. 3*a* is shown as a perspective view a trowel plate 1; la equipped with concrete grinding equipment according to the invention to be coupled with the rotor of the concrete trowel machine and in FIG. 3*b* respectively a trowel wing 1; 1*b* to be coupled with each coupling arm of the concrete trowel machine's rotor.

The fastening arrangement 3 comprises e.g. with reference to FIG. 4*a* a perforation 3*c* that goes at least through the concrete trowel organ 1, such as the trowel plate 1*a* or trowel wings 1*b*, in order to fasten the diamond grinding arrangement 2 to the trowel organ 1 e.g. on the principle manifesting itself in FIGS. 4*c*, 6*b* and 7*b* by the fastening part 3*b* of the diamond grinding arrangement's 2 fastening frame 3*a* that goes through the perforation 3*c* in the trowel organ 1.

Furthermore, in FIG. 8 is shown an embodiment implemented in the above described manner, wherein the fastening part 3*b* of the fastening frame of the diamond grinding arrangement is arranged long enough, so that the diamond grinding arrangement 2 is supported on the concrete trowel organ 1 through perforations 3*c*, 3*c*' being present both therein and in the rotor R.

As a furthermore advantageous embodiment of the apparatus according to the invention, the fastening frame 3*a* is arranged in connection with the diamond grinding arrangement 2, such as the diamond disk 2*a*, chemically, such as by gluing, mechanically, such as by a sticker gripping joint or a snap-joint, melting, such as by welding or injection moulding, and/or in a corresponding manner.

As a furthermore advantageous embodiment of the apparatus according to the invention, the fastening arrangement 3 comprises e.g. with reference to FIGS. 4*b* and 8 an expansion assembly 3*b*' at an end of the fastening part 3*b* in order to lock the diamond grinding arrangement 2, such as the diamond disk 2*a*, against the back surface tp of the trowel plate 1*a* or the trowel wing 1*b*.

Especially in the type of embodiments as shown in FIGS. 9 and 10*a*-10*c*, the fastening part 3*b* of the diamond grinding arrangement 2 is formed wedge-like by its cross section in order to couple the diamond grinding arrangement e.g. with the fastening parts 3*b* of the left hand sided diamond disks 2 in FIGS. 9 and 10*a* through triangle shaped perforations 3*c*, 3*c*' in the trowel plate 1*a* and/or the rotor R against the back surface tp of the trowel plate 1*a* or the rotor R. The right hand sided diamond disks in FIGS. 9 and 10*a* are for their part arranged to be coupled in place with an interference fit between the fastening frames 3*b* and the perforations 3*c*, 3*c*' in the trowel plate 1*a* and/or the rotor R, wherein the diamond disks 2*a* are forced into the perforations 3*c*, 3*c*' with a tight fit.

As a furthermore advantageous embodiment of the apparatus according to the invention e.g. with reference to FIGS. 4*b*-4*c*, the fastening arrangement 3 includes spring means 3*d* in order to enable deflection movements of the diamond grinding arrangement 2, such as the diamond disk 2*a*, with respect to the concrete scrubbing organ 1, regarding which some advantageous exemplary alternatives of the spring means are shown in FIGS. 5*a*, 5*b*, 6*a*-6*c* and 7*a*-7*c*.

As a furthermore advantageous embodiment of the apparatus according to the invention, a cross section area of one or more holes 3*c*, 3*c*' for the fastening part 3*b* in the concrete trowel organ 1, such as the trowel plate 1*a* or the trowel wing 1*b*, is/are arranged essentially larger than a cross section area of the fastening part 3*b*, which enables e.g. a deflection motion of the diamond grinding arrangement 2 as shown in FIGS. 4*d*, 6*c* and 7*c* without the need to manufacture the fastening part necessarily from elastic material, or when utilizing the wedge-like form of the fastening part as shown in FIGS. 8, 9, 10*a*-10*c*, the locking and releasing motions thereof in the radial direction as shown in FIG. 10*b*. In FIG. 10*c* is shown for its part a fastening part 3*b* of the diamond disk 2; 2*a* that is locked in place immovably with an interference fit. According to FIG. 10*a*, the invention may also be applied by using the concrete trowel machine's rotor R together with its perforations 3*c* directly as the concrete trowel organ 1.

As a furthermore advantageous embodiment of the apparatus according to the invention, the spring means 3*d* are arranged e.g. according to FIG. 4*b*-4*d* or 5*a*, 5*b* with a flexible formation of the fastening frame's 3*a* back surface, being made of elastic and/or flexible material, wherein as a furthermore advantageous embodiment especially with reference to FIGS. 6*a*-6*c* and 7*a*-7*c*, the spring means 3*d* are arranged with a spring rib or a spring ring structure made of elastic and/or flexible material on the back surface of the fastening frame 3*a*.

As a furthermore advantageous embodiment of the apparatus according to the invention, the fastening part 3*b* is arranged e.g. on the principle as shown in FIGS. 4*b*, 5*a*, 6*b*, 7*b* and 8 with an end 3*b*' of the fastening part 3*b* that gets locked against the back surface tp of the concrete trowel organ 1 with a snap-lock joint. The principle described above manifests itself also in the left hand sided diamond disks 2; 2*a* presented in FIGS. 9 and 10*a*.

As a furthermore advantageous embodiment of the apparatus according to the invention, the fastening part 3*b* is arranged with a counterpart that gets supported against the back surface tp of the concrete trowel organ 1 and that is to be fastened removably to the fastening part 3*b*. As an example of the above described, reference is made to the embodiment according to FIG. 5*b*, wherein a screw coupled with the fastening frame by its head is supported against the back surface tp of the trowel organ with a nut 3*b*' to be screwed on the thread part of the screw.

It is clear that the invention is not limited to the embodiments shown or described above, but it may be altered in very many ways within the basic idea of the invention, e.g. by using the embodiments shown in the appended drawings mixed with each other etc. Thus e.g. the "rotor embodiment" shown in FIG. 10*a* may also be utilized by coupling the same with a customary rotor of a concrete trowel machine. Also the types of implementations shown in the appended drawings may be carried out with structures and appearances differing from what has been shown in order to bring about the same basic purpose of the invention. Additionally, components or parts thereof belonging to the apparatus according to the invention may also be manufactured from the most different kinds of materials by utilizing the most different kinds of manufacturing techniques e.g. by using plastic, ceramic, composite, carbon fibre and/or the like, not to mention metal structured, such as light alloy implementations.

The invention claimed is:

1. Apparatus for grinding a concrete floor surface, in order to perform grinding with a manual, a pullable or a ride-on concrete trowel machine, wherein the apparatus comprises a concrete trowel organ to be used with the concrete trowel machine and a diamond grinding arrangement, such as one or several removable diamond disks or like, to be coupled in connection with the concrete trowel organ by means of a fastening arrangement, wherein a fastening arrangement for coupling the diamond grinding arrangement removably in connection with the concrete trowel organ comprises a fastening frame that is in connection with the diamond grinding arrangement, existing on a scrubbing surface of the concrete trowel organ, and a fastening part extending from the fastening frame and, while going through the concrete trowel organ, getting supported against a back surface of the same, characterized in that, a cross section area of a hole for the fastening part in the concrete trowel organ, such as a trowel plate or a trowel wing, is arranged essentially larger than a cross section area of the fastening part in order to make possible a deflection motion of the diamond grinding arrangement or locking and releasing motions thereof in radial direction.

2. Apparatus according to claim 1, in which the concrete trowel organ comprises a metallic trowel plate or trowel wings, wherein a back surface thereof is provided with a coupling arrangement for coupling the concrete trowel organ with a rotor of the concrete trowel machine, characterized in that, the fastening arrangement comprises an expansion assembly at an end of the fastening part in order to lock the diamond grinding arrangement, such as a diamond disk, against the back surface of a trowel plate or a trowel wing.

3. Apparatus according to claim 1, characterized in that, the fastening arrangement includes spring means in order to enable deflection movements of the diamond grinding arrangement, such as a diamond disk, with respect to the concrete trowel organ.

4. Apparatus according to claim 3, characterized in that, the spring means are arranged with a flexible formation of the fastening frame's back surface, being made of elastic and/or flexible material.

5. Apparatus according to claim 3, characterized in that, the spring means are arranged with a spring rib or a spring ring structure made of elastic and/or flexible material on a back surface of the fastening frame.

6. Apparatus according to claim 1, characterized in that, the fastening part is arranged with an end of the fastening part that gets locked against the back surface of the concrete scrubbing organ with a snap-lock joint.

* * * * *